United States Patent [19]

White

[11] 4,249,835

[45] Feb. 10, 1981

[54] MINE ROOF SUPPORT PLATE

[76] Inventor: Claude C. White, P.O. Box 1208, Birmingham, Ala. 35201

[21] Appl. No.: 10,429

[22] Filed: Feb. 8, 1979

[51] Int. Cl.[3] ..... E21D 21/00; F16B 29/00

[52] U.S. Cl. ..... 405/259; 411/61; 411/72

[58] Field of Search ..... 405/259, 260; 85/50 R, 85/62, 63, 79; D8/398, 399, 400, 397

[56] References Cited

U.S. PATENT DOCUMENTS

| | | | |
|---|---|---|---|
| D. 27,427 | 7/1897 | Purdy | D8/399 |
| 2,369,865 | 2/1945 | Spencer | 85/62 |
| 2,972,387 | 2/1961 | Severson | 85/50 R X |
| 3,238,731 | 3/1966 | Seifert et al. | 405/259 |
| 3,478,523 | 11/1969 | Reusser et al. | 85/62 X |
| 3,544,053 | 12/1970 | Ingalls | 85/50 R X |

FOREIGN PATENT DOCUMENTS

| | | | |
|---|---|---|---|
| 660827 | 4/1963 | Canada | 85/50 R |

*Primary Examiner*—Dennis L. Taylor
*Attorney, Agent, or Firm*—Shlesinger, Arkwright, Garvey and Dinsmore

[57] ABSTRACT

A support plate for a mine roof including a substantially flat body engageable with the mine roof, the body having an enlarged central opening through which are passed one end of a roof bolt on which is threaded an expansion shell which is inserted into a mine roof opening. Ribs extend longitudinally of the flat body on both sides of the central opening for additional strength. The ribs are spaced a predetermined distance apart on opposite sides of the central opening. Centering members are provided on the body portion intermediate the ribs on opposite sides of the central opening, the centering members and ribs serving to center the washer and bolt portion of the bolt assembly.

3 Claims, 3 Drawing Figures

MINE ROOF SUPPORT PLATE

BACKGROUND OF THE INVENTION

In the use of bolt and expansion shell assemblies for supporting mine roofs, it has been conventional practice to interpose a support member between the bolt head and the mine roof in order to afford greater surface area contact with the mine roof. These suport members have, in the past, taken the form of pieces of wood and more recently, plates made of steel or other strong metallic material. Examples of metallic plates are found in U.S. Pat. Nos. 3,238,731, 3,478,523 and 4,037,418.

It will be noted from a consideration of the support plates of the above-noted patents that the design thereof requires the use of ductile alloys in order to form a support plate of this desired shape. This increases the cost of the support plate.

Also, in the installation of support plates and mine roof bolt assemblies, installation is effected by inserting the roof bolt through the central opening of the supporting plate, following which an expansion shell is threaded on the roof bolt. The bolt and expansion shell are then inserted into a mine roof opening and the bolt tightened. This necessitates holding the heavy supporting member and bolt while the expansion shell is threaded thereon, with resultant strain and fatigue on the installer when a member of the assemblies are positioned in the mine roof.

SUMMARY OF THE INVENTION

The present invention is a mine roof support plate of metallic construction which is of simple, yet strong, construction which, by virtue of its simplicity, may be stamped out of less ductile, less expensive material.

The present support plate includes a substantially flat body having a central opening and raised longitudinally extending ribs on both sides of the opening for added strength. The central opening is enlarged so that a portion of the roof bolt with an expansion shell threaded thereon may be passed therethrough for insertion into a mine roof opening.

In order to effect centering of the bolt with respect to the enlarged central opening of the plate, the ribs are located a predetermined distance apart which is substantially equal to the diameter of a washer lying beneath the head of the roof bolt and forming a part of the assembly. Centering of the bolt is further effected by means of protrusions in the form of struck portions intermediate the ribs and on opposite sides of the central opening, the distance between the protrusions being substantially equal to the diameter of the washer.

The support plate of the present invention is flat throughout the major portion of its length and breadth, thereby affording maximum surface area contact with the mine roof. Furthermore, in view of its simplicity and design, the installation of the support plate and bolt assembly is effected simultaneously.

DETAILED DESCRIPTION OF THE INVENTION

Figure 1:
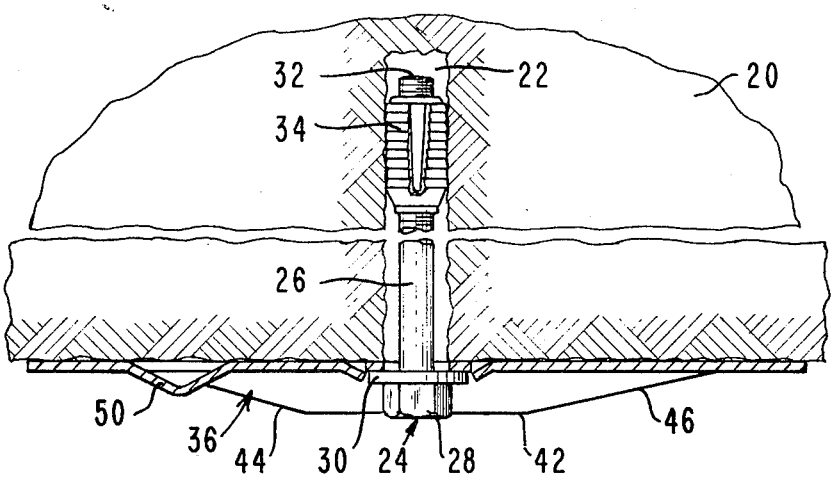
FIG. 1 is a longitudinal sectional view of the mine roof support plate of the present invention illustrating its use.

In FIG. 1, there is illustrated a mine roof 20 having a vertical opening 22 therein into which a mine roof bolt assembly 24 is inserted. Bolt assembly 24 includes a roof bolt 26, one end of which is provided with a head 28 having a washer 30 engaged therewith. The opposite end of bolt 26 is threaded at 32 for engagement with a conventional expansion shell 34. The support plate of the present invention is indicated generally at 36 and is held against mine roof 20 by washer 30 of roof bolt assembly 24 in order to provide substantial surface area contact with the mine roof for supporting the latter.

Figure 2:
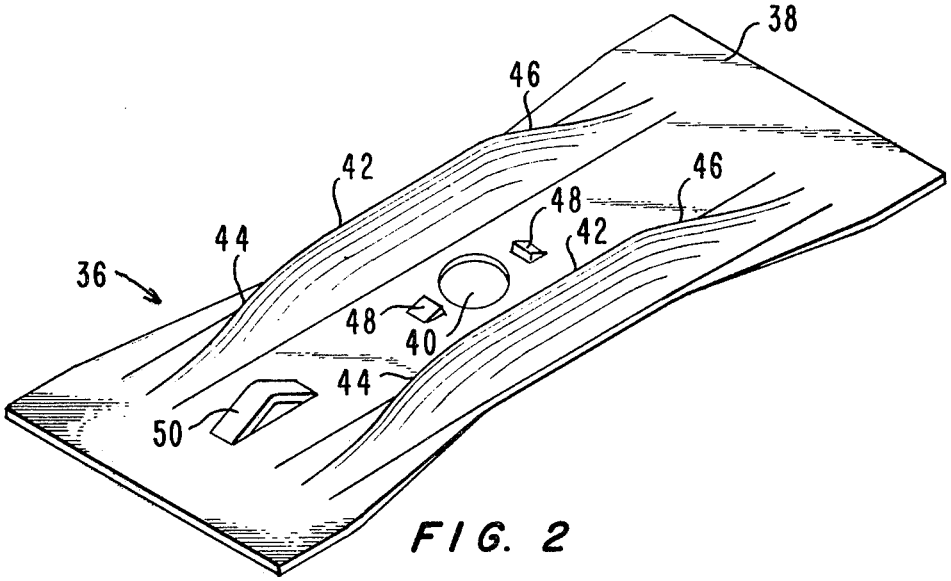
FIG. 2 is a perspective view of the present mine roof support plate.
Figure 3:
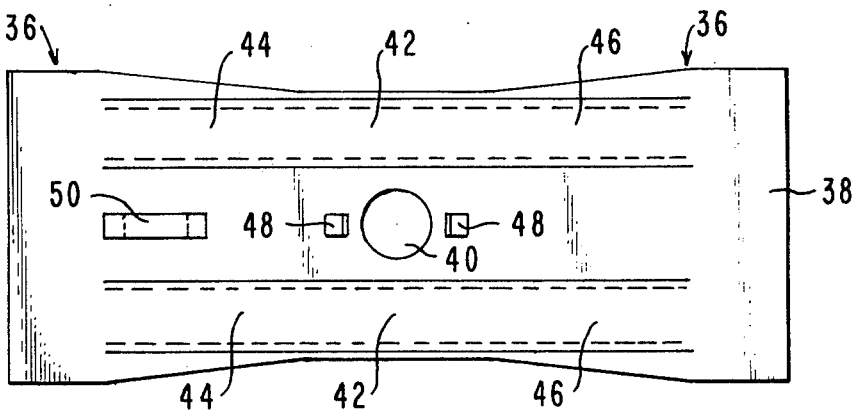
FIG. 3 is a plan view of the same.

As shown to advantage in FIGS. 2 and 3, support plate 36 includes a rectangular flat body 38 preferably made of a high strength, low ductile, low cost steel such as carbon steel. For optimum results the plate is approximately 16" in length, $6\frac{1}{2}$" wide and 3/16" thick.

Flat body 38 is provided with a central opening 40 which is enlarged substantially in order to permit bolt 26 and expansion shell 34 to be inserted therethrough together for positioning in mine roof opening 22. An opening of approximately $1\frac{3}{8}$" in diameter accommodates an expansion shell of substantially $1\frac{1}{4}$" in diameter.

It is a salient feature of the present invention to provide a pair of elongated, spaced, parallel ribs extending longitudinally of plate 38 on both sides of central opening 40 for approximately three quarters of the length thereof, which ribs are pressed outwardly from one face of the body to lend additional strength to the supporting plate. Each rib includes a main portion approximately 1" in height, and $4\frac{1}{2}$" in length. The terminals of main portion 42 issue into tapering end portions 44 and 46 of progressive decreasing height, each of which is approximately $3\frac{7}{8}$" long.

The ribs of plate 38 are spaced a predetermined distance apart corresponding to the diameter of washer 30 so that the washer and correspondingly bolt 26 are adjusted centrally of opening 40 with respect to the transverse dimension of body 38.

In order to center bolt assembly 24 in opening 40 with respect to the longitudinal dimension of body 38, there are provided a pair of upstanding protrusions 48 located on opposite sides of opening 40. Protrusions 48 are preferably struck from body 38 and, in the manner of the reinforcing ribs, are spaced apart a distance substantially equal to the diameter of washer 30. Therefore, by virture of the ribs and protrusions, bolt 26 and washer 30 are automatically centered in enlarged opening 40 thereby effecting proper positioning of the bolt with respect to support plate 36 and mine roof opening 22.

Body 38 is further provided with a V-shaped hanger 50 which is also struck from body 38 in order to allow electric wires or other equipment in the mines to be hung therefrom.

The support plate of the present invention affords simple, but effective means of lending greater surface area contact to a mine roof supported by a roof bolt assembly, the simplicity of construction enabling the reinforced plate to be manufactured from low cost steel.

By providing an enlarged central opening in the support plate, insertion of the roof bolt assembly to the support plate is facilitated thereby making it simpler to install the support plate and the bolt assembly with respect to the mine roof. Centering of the roof bolt assembly with respect to the central opening is automatically effected and the reinforcing ribs serve the dual function of strengthening the support plate and also, in conjunction with protrusions 48, centering the washer of the bolt assembly.

While there has herein been disclosed the presently preferred form of this invention, it is to be understood that such has been done for purposes of illustration only, and that various changes may be made therein within the scope of the appended claims.

What is claimed is:

1. In combination with a mine roof bolt assembly including a bolt having a head and washer at one end, the opposite end of the bolt being threaded for engagement with an expansion shell, a mine roof support plate comprising (a) a substantially flat rectangular body made of high strength, low ductile, low cost metal (b) said flat body having an enlarged central opening through which the threaded end of the bolt and expansion shell are passed (c) spaced ribs protruding outwardly from one face of said flat body on both sides of the enlarged central opening, and extending longitudinally through the major portion of the body's length, for adding strength to the flat body (d) the distance between said ribs being substantially equal to the diameter of the washer of the roof bolt assembly, whereby the bolt periphery proximate the ribs will be spaced equidistant from the portion of the flat body defining the central opening thereof, and (e) upstanding, spaced protrusions on said one face of said flat body on both sides of said enlarged central opening and intermediate the spaced ribs (f) the distance between said spaced protrusions being substantially equal to the diameter of the washer of the roof bolt assembly, whereby the bolt periphery proximate the protrusions will be spaced equidistant from the portion of the flat body defining the central opening thereof.

2. The mine roof support plate of claim 1, wherein (a) each of said ribs includes a main rib portion of uniform height (b) the terminals of said main portion issuing into tapering end portions of progressively decreasing height.

3. The mine roof support plate of claim 2, with the addition of (a) a V-shaped hanger struck from said one face of said flat body to allow equipment in the mine to be hung therefrom.

* * * * *